United States Patent [19]

Roarty et al.

[11] 4,431,521

[45] Feb. 14, 1984

[54] BENZENE RECOVERY PROCESS

[75] Inventors: John C. Roarty, Rockaway; Malcolm L. Campbell, Madison, both of N.J.

[73] Assignee: Exxon Research & Engineering Co., Florham Park, N.J.

[21] Appl. No.: 423,732

[22] Filed: Sep. 27, 1982

[51] Int. Cl.[3] ..... C07C 35/04

[52] U.S. Cl. ..... 208/134; 208/101; 208/348

[58] Field of Search ..... 208/134, 101, 348

[56] References Cited

U.S. PATENT DOCUMENTS

| | | | |
|---|---|---|---|
| 3,027,413 | 3/1962 | Moy et al. | 585/322 |
| 3,520,799 | 7/1970 | Forbes | 208/101 |
| 3,547,805 | 12/1970 | Mitchell | 208/348 |
| 3,992,465 | 11/1976 | Juguin et al. | 585/252 |
| 4,158,025 | 6/1979 | Addison | 585/321 |
| 4,158,026 | 6/1979 | Addison | 585/321 |
| 4,333,817 | 6/1982 | O'Brien | 208/101 |
| 4,333,818 | 6/1982 | Coste | 208/101 |
| 4,333,819 | 6/1982 | Scheifele, Jr. | 208/101 |

*Primary Examiner*—Curtis R. Davis

*Attorney, Agent, or Firm*—M. D. Bittman

[57] ABSTRACT

A process is disclosed for improving the recovery of benzene from a reforming process by adding to the reformer effluent a heavy oil, then recovering the benzene in a flash drum.

11 Claims, 3 Drawing Figures

EFFECT OF HEAVY OIL ON BENZENE RECOVERY AND RECYCLE GAS PURITY

BENZENE RECOVERY PROCESS

BACKGROUND OF THE INVENTION

This invention relates to an improved method of recovering benzene from a reforming process, more particularly to improved benzene recovery from a reforming process which provides high benzene yields.

Benzene has enjoyed a continually increasing demand within the marketplace due principally to its versatility as a gasoline blending component and its use in the production of a wide spectrum of petrochemical compounds. Benzene, as well as other aromatic hydrocarbons, are typically produced through a catalytic reforming process in which a naphtha hydrocarbon feed and a hydrogen stream are reacted under pressure and high temperatures in the presence of a catalyst to produce aromatic compounds. Conventional recovery techniques, as shown in FIG. 1, then call for sending the reformer effluent to a flash drum with the bottoms sent to a stabilizer and the majority of vapors recycled back to the reformer feed.

While most of the aromatics including benzene are condensed and recovered as bottoms in the flash drum, a significant amount of benzene may be lost in the vapor stream. This loss of benzene becomes especially pronounced when a reforming process is employed which provides a high benzene yields.

A reforming process which provides high benzene yields will generally utilize a light hydrocarbon feed containing a high percentage of $C_6$ hydrocarbons (e.g., at least 40% by weight) and which uses a catalyst which under proper reforming conditions produces a stream containing a high benzene concentration. Recovery of benzene from such a stream utilizing conventional recovery techniques becomes increasingly difficult. For example, with a reforming process which produces an effluent containing about 50 wt. % benzene, conventional recovering techniques utilizing a flash drum results in recovering of only about 80 percent by wt. of the benzene in the effluent.

It is a feature of this invention to provide a process for improving the recovery of benzene from a reforming process. It is a further feature of this invention to provide an improved method of recovering benzene from a reforming process which provides high benzene yields.

SUMMARY OF THE INVENTION

Briefly, this invention improves the recovery of benzene from a reforming process by adding to the reformer effluent a heavy oil having a boiling point higher than the benzene and then recovering the benzene in a flash drum. Preferably, the reforming process involves a light hydrocarbon feed containing at least 40% by weight of $C_6$ hydrocarbons and produces a reformer effluent containing benzene at a level of at least 25 wt. % of the effluent.

DETAILED DESCRIPTION OF THE INVENTION

Figure 1:
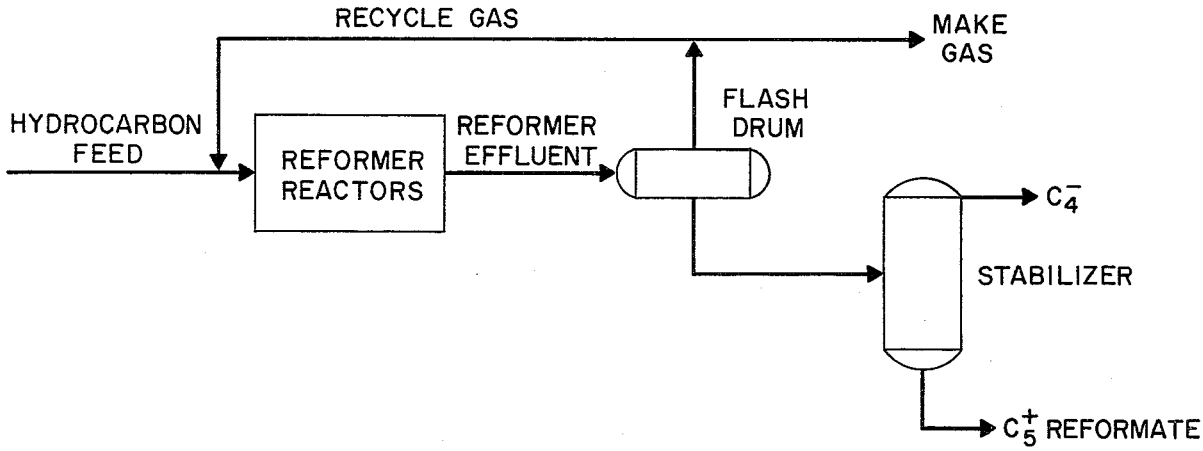
FIG. 1 is a flow diagram of a conventional reforming and recovery process.

This invention is directed to a method of improving the recovery of benzene produced in a reforming process. While this invention is useful in improving the recovery of benzene in reforming processes which provide a broad range of benzene yields, it is especially significant for reforming processes which produce high benzene yields, i.e. over 30% by wt. of the $C_5$+ hydrocarbons (i.e. pentanes and heavier hydrocarbons).

The reforming process involves reacting a hydrocarbon feed under reforming conditions to produce an effluent which contains benzene. The hydrocarbon feed for the reforming process is normally a liquid hydrocarbon boiling within the range of about 100° F. to 425° F. with various fractions such as a light naphthas (boiling range of about 100° F. to 200° F.) or heavy naphthas (boiling range of about 200° F. to 400° F.) also being suitable as feeds. Preferably, in order to maximize the benzene yield in the reforming process, a light hydrocarbon feed is utilized which contains a substantial amount of $C_6$ hydrocarbons, i.e. at least 40% by wt., preferably at least 60% by wt. of the feed. The hydrocarbon feed is then reacted with hydrogen in the presence of a catalyst under reforming conditions to convert the naphthenes and paraffins to aromatic hydrocarbons. The catalyst employed will usually contain Groups VIB, VIIB, VIII, IB, IVA, VIA compounds loaded on an amorphous silica, amorphous alumina or various zeolitic supports with the preferred catalyst being chosen for its ability to maximize benzene yield. For example, catalyst such as Pt-zeolite L (see U.S. Pat. No. 4,104,320) and Pt—Sn—$Al_2O_3$ (British Pat. No. 1,348,653) etc. are known in the art to produce high benzene yields.

In general, the effluent which comes directly from the reformer will contain 15 to 90% of benzene by wt. of reformer effluent and preferably 25 to 90% of benzene by wt. of reformer effluent. The reformer effluent preferably will contain benzene at a level of 30 to 99% by weight of the $C_5$+ hydrocarbons and contain $C_7$+ hydrocarbons (i.e. heptane and heavier hydrocarbons) at a level of less than 30% by weight of the $C_5$+ hydrocarbons. Even more preferred, the reformer effluent will contain benzene at a level of 40 to 80% by weight of the $C_5$+ hydrocarbons and contain $C_7$+ hydrocarbons at a level of less than 20% by weight of the $C_5$+ hydrocarbons.

In order to improve the benzene recovery, a heavy oil is added to the reformer effluent. The heavy oil is a hydrocarbon having a boiling point higher than benzene to assist in the subsequent recovery of benzene. Preferably, the heavy oil can be an aromatic, naphthenic or paraffinic compound having a boiling range between 190° F. and 600° F. In a preferred embodiment, the heavy oil will have a boiling range between about 230° F. and 310° F. and contain aromatics, paraffins and naphthenes having 8 to 9 carbon atoms. The heavy oil is added to the effluent in an amount effective to increase the subsequent recovery of benzene. Generally, this amount will range from 0.5 to 20:1 volume ratio of heavy oil to benzene in the effluent and preferably, in an amount ranging from 1 to 10:1 volume ratio of heavy oil to benzene in the effluent.

Through this addition of heavy oil to the effluent, the subsequent recovery of benzene is substantially improved. This improvement ranges from a relatively minor improvement when there is a low benzene yield in the reformer (e.g. below 15% by weight of benzene in the effluent), to a major increase in benzene recovery when the benzene yield in the reformer is high (e.g. above 30% by weight of benzene in the effluent). An additional benefit is the addition of heavy oil will reduce the level of $C_3$+ hydrocarbons (propane and heavier hydrocarbons) in the make gas stream, thus providing a purer hydrogen recycle stream for the reformer, as well as providing a make gas stream with higher purity hydrogen which could be used directly in the refinery without additional purifications.

Following the addition of the heavy oil to the benzene, the benzene is then recovered in a flash drum (gas-liquid separation). The flash drum is defined as a process wherein higher boiling hydrocarbons are condensed and removed in the bottoms, while lower boiling hydrocarbons and hydrogen are maintained in the vapor phase and removed as overhead product. The operating conditions for a flash drum used to recover benzene generally involve temperatures of about 60° to 130° F. and pressures of 40 to 200 psia.

Figure 2:
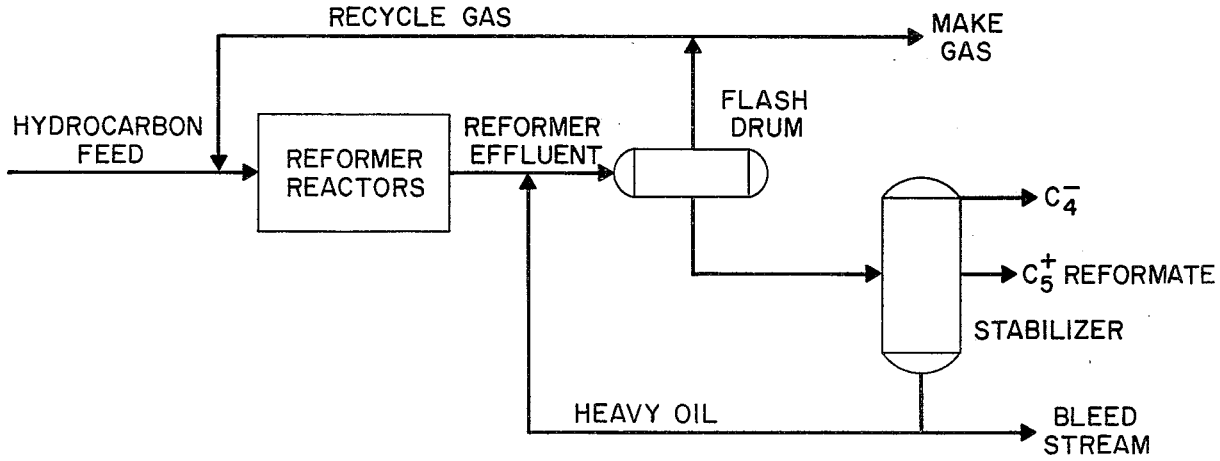
FIG. 2 is a flow diagram of a reforming process in which heavy oil is added to the reformer effluent prior to introduction into the flash drum.

In one preferred embodiment, as shown in FIG. 2, the bottoms stream from the flash drum containing the benzene are sent to a stabilizer which separates the bottoms stream into a $C_4$—fraction (butane and lighter hydrocarbons), a $C_5$+ reformate containing the benzene and a stabilizer bottom containing heavy oil. The stabilizer bottoms can then be recycled as the heavy oil to be added to the reformer effluent prior to recovery of the benzene in the flash drum.

EXAMPLE 1

A light hydrocarbon feed containing $C_6$ hydrocarbons is reformed with a pt-K zeolite L catalyst under the following conditions: temperature of 500° C.; pressure of 145 psia; $H_2$/oil mole ratio of 6; and at a LHSV of 2.5 to produce an effluent stream containing 80.9 wt. % of $C_5$+ hydrocarbons; 49.5 wt. % of benzene and 0.5% $C_7$+ hydrocarbons, all percents by weight of the effluent (see Example 7 of U.S. Pat. No. 4,104,320).

The benzene is recovered from the effluent through conventional recovery techniques, as shown in FIG. 1, by use of a flash drum at a temperature of 110° F. and pressure of 90 psia. This technique results in a benzene recovery of about 80% by weight of the benzene in the effluent.

The benzene is also recovered, as shown in FIG. 2, by the addition to the effluent of 9 barrels of heavy oil (boiling range 281° F.–292° F.) per barrel of benzene in the effluent. Then the benzene is recovered in a flash drum at a temperature of 90° F. and a pressure of 90 psia resulting in a recovery of 97% by weight of the benzene in the effluent.

EXAMPLE II

Figure 3:
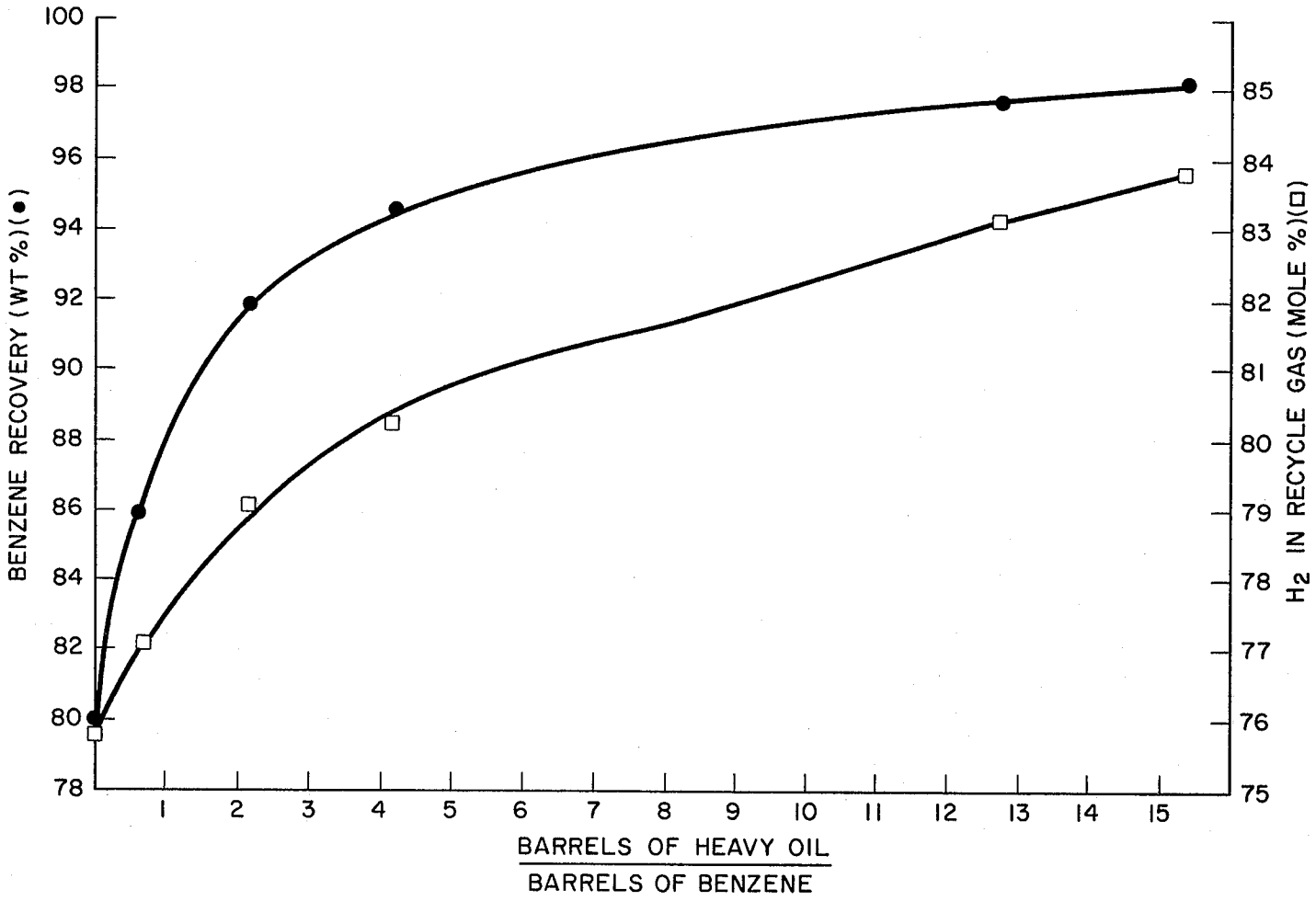
FIG. 3 is a graph of Example II showing the benzene recovery and hydrogen recycle gas purity upon the addition of varying amounts of heavy oil to a reformer effluent.

Varying amounts of heavy oil (boiling range 281° F.–292° F.) are added to a reformer effluent stream containing 80.9 wt. % $C_5$+ hydrocarbons, 49.5 wt. % benzene and 0.5 wt. % of $C_7$+ hydrocarbons (all percents by weight of the effluent), followed by recovering the benzene, as shown in FIG. 2, in a flash drum operated at a temperature of 110° F. and a pressure of 90 psia. The results are charted in the graph of FIG. 3 with the left hand side of the graph representing the benzene recovery as plotted with dots (•), and the right hand side of the graph representing hydrogen purity in recycle gas as plotted with squares (□).

The graph clearly shows that the benzene recovery and the hydrogen purity in the recycle gas are substantially improved by the addition of heavy oil to the reformer effluent prior to the recovery of benzene in the flash drum.

What is claimed is:

1. A process for recovering benzene from a reforming process comprising:

(a) reacting a hydrocarbon feed under reforming conditions to produce an effluent containing benzene;

(b) adding to the effluent a heavy oil having a boiling point higher than benzene in an amount effective to increase the subsequent recovery of benzene; and (c) then recovering the benzene in a flash drum.

2. Process of claim 1 wherein the effluent contains 15 to 90 percent of benzene by weight of the effluent.

3. Process of claim 2 wherein heavy oil is added in an amount ranging from 0.5 to 20:1 volume ratio of heavy oil to benzene in the effluent.

4. Process of claim 3 wherein the heavy oil is added in an amount ranging from 1 to 10:1 volume ratio of heavy oil to benzene in the effluent.

5. Process of claim 3 wherein the heavy oil has a boiling range between 190° F. and 600° F.

6. Process of claim 4 wherein the heavy oil has a boiling range between 230° F. and 310° F.

7. Process of claim 3 wherein the reformer effluent contains benzene at a level of 30 to 99 percent by weight of the $C_5$+ hydrocarbons and contains $C_7$+ hydrocarbons at a level of less than 30 percent by weight of the $C_5$+ hydrocarbons.

8. Process of claim 7 wherein the effluent contains benzene at a level of 40 to 80 percent by weight of the $C_5$+ hydrocarbons and contains $C_7$+ hydrocarbons at a level less than 20% by weight of the $C_5$+ hydrocarbons.

9. Process of claim 6 wherein the effluent contains 25 to 90 percent of benzene by weight of the effluent.

10. Process of claim 9 wherein the hydrocarbon feed is a light feed containing at least 40 percent by weight of $C_6$ hydrocarbons.

11. Process of claim 1 further comprising separating in a stabilizer the benzene recovered in the flash drum into a benzene containing stream and a heavy oil containing stream, then recycling the heavy oil separated in the stabilizer to the reformer effluent prior to recovery of the benzene in the flash drum.

* * * * *